United States Patent [19]

Larson

[11] 4,026,551

[45] May 31, 1977

[54] BASEBALL PITCHER'S PRACTICE TARGET

[76] Inventor: Charles W. Larson, 8211 Mango, Morton Grove, Ill. 60053

[22] Filed: Apr. 9, 1976

[21] Appl. No.: 675,527

[52] U.S. Cl. ..... 273/26 A; 273/29 A; 273/181 K; 273/127 R; 273/30

[51] Int. Cl.[2] ..... A63B 69/40

[58] Field of Search ..... 27/26 R, 26 A, 29 A, 27/30, 181 R, 181 K, 102 R, 127 R

[56] References Cited

UNITED STATES PATENTS

| | | | |
|---|---|---|---|
| 2,162,438 | 6/1939 | Letarte | 273/26 A |
| 3,001,790 | 9/1961 | Pratt | 273/26 A |
| 3,968,967 | 7/1976 | Nally | 273/30 |

FOREIGN PATENTS OR APPLICATIONS

| | | | |
|---|---|---|---|
| 2,098,829 | 10/1972 | France | 273/29 A |

*Primary Examiner*—Richard C. Pinkham
*Assistant Examiner*—T. Brown
*Attorney, Agent, or Firm*—Joel Halpern

[57] ABSTRACT

A baseball pitcher's target includes a rebound wall surface which is divided into an upper half section and a lower half section. Each of the half sections is tapered rearwardly from the horizontal mid-point of the wall surface. The upper half section thus imparts an upwardly directed force component to a ball which strikes it whereas the lower half section imparts a downwardly directed force component to a ball which impinges upon such surface. Additional elements are secured to both the upper and lower half sections to impart laterally directed force components to a ball which strikes them and arcuately contoured elements are secured to both of the half sections, the arcuately contoured elements secured to the lower half section imparting a downwardly directed force component to a ball which strikes them whereas the arcuately contoured elements secured to the upper half section impart an upwardly directed force component to a ball which strikes them. Marginal side portions of the wall surface are tapered rearwardly.

5 Claims, 4 Drawing Figures

BASEBALL PITCHER'S PRACTICE TARGET

BACKGROUND OF THE INVENTION

The present invention relates to a practice target and more particularly to a baseball pitcher's practice target.

Targets of various types have been available heretofore. One such target, adapted especially for use by tennis players and the like is disclosed in U.S. Pat. No. 3,697,068 issued Oct. 10, 1972 to Julia P. McDougall. Essentially, the target device includes a rebound wall which is non-planar and which may include indented or projecting formations which impart unpredictable bounces to the ball in order to sharpen the response of the player and accustom him to rebounds which may follow unexpected paths.

U.S. Pat. No. 3,633,909 issued Jan. 11, 1972 to David Doynow discloses a baseball pitcher's practice device and essentially comprises a life-size manikin and an adjustable rectangular frame member which delineates the "strike zone". Although the Doynow device is an improvement over the rebound wall of McDougall in the teaching of accuracy of delivery for a baseball pitcher Doynow device nevertheless fails to take into account several fundamental pitching principles which require constant reinforcement through practice. For example, a pitcher is taught that when the situation demands that a pitch be delivered which will most likely result in the batter hitting the ball on the ground, i.e., a "grounder" such pitch should be delivered to the lower area of the strike zone whereas when the situation demands that the batter hit the ball into the air, i.e., a "fly ball", the pitch should be delivered to the upper area of the strike zone. It is also important to train the pitcher to be ever aware that pitches delivered to the inside of the strike zone will more than likely be "pulled" along that foul line. None of the baseball pitcher's practice targets available heretofore have provided for such training. Indeed, random placement of the indentations and projections as taught by the McDougall patent would have an adverse effect upon the training of a baseball pitcher.

SUMMARY OF THE INVENTION

It is one object of this invention to provide a baseball pitcher's target which reinforces the teaching of certain pitching fundamentals through selective rebounding of the ball on the various areas of the target.

It is another object of this invention to provide a baseball pitcher's target which is of relatively simple construction and can be carried from one location to another without difficulty for the teaching of ball control in accordance with pitching fundamentals.

According to the present invention there is provided a baseball pitcher's target comprising:

a rebound wall surface defined by opposed side walls and opposed end walls, , said wall surface including a frontal area divided into a downwardly and rearwardly tapered lower half section and an upwardly and rearwardly tapered upper half section, the upper and lower half sections being provided adjacent each of the side walls with vertically-extending rearwardly and outwardly tapered portions;

A plurality of elongated notched elements secured to the frontal area adapted when struck by a ball to impart to the ball a laterally directed force component;

and a plurality of arcuately contoured elements secured to the frontal area adapted when struck by a ball to impart to the ball a vertically directed force component.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
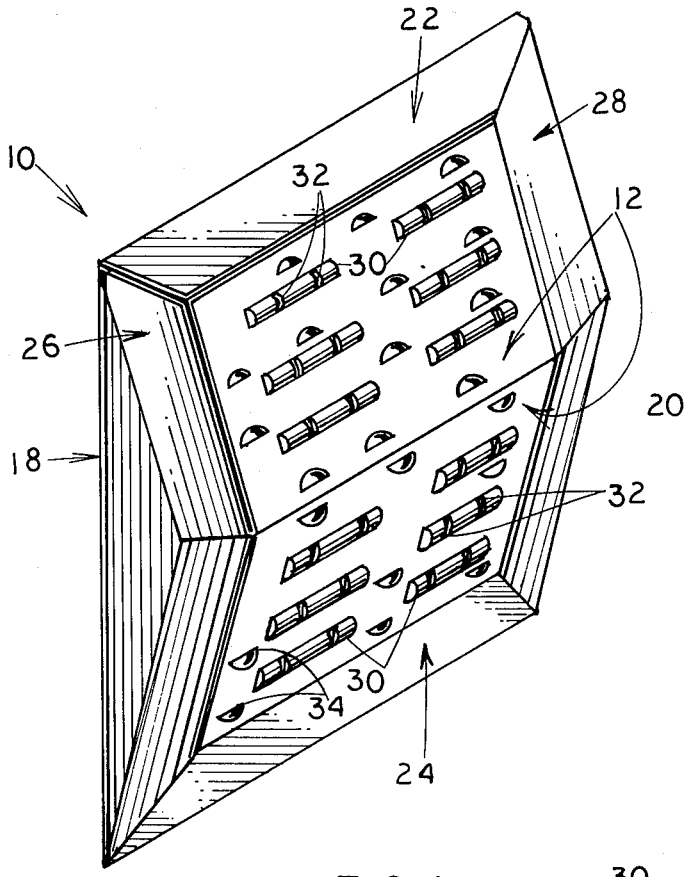
FIG. 1 is a perspective view of a baseball pitcher's target embodying the present invention in place in the ground.

Referring to the drawings there is indicated generally by reference numeral 10 a baseball pitcher's target which is especially designed to impart rebounding trajectories to a ball which may inpinge thereon according to a generally prearranged pattern to reinforce certain pitching fundamentals. The target can be made of any suitable rigid material such as wood, reinforced sheet metal or plastics which will afford sufficient rigidity to withstand the impact of a pitched rubber ball and impart adequate rebounding force to the ball so as to impel the ball back to the pitcher or to a location approximately equi-distant.

The target is given a rebound wall surface 12 that is divided into essentially an upper half section 14 and a lower half section 16 for a purpose which will become clear. The rebound wall surface is defined by a pair of opposed side walls 18, 20 and opposed end walls 22, 24. The rebound wall surface thus presents a total frontal area which embraces the upper and lower half sections 14, 16. The lower half section is provided with a downwardly and rearwardly taper which begins at approximately the horizontal mid-point of the frontal area. The upper half section is given an upwardly and rearwardly taper which also begins approximately at the horizontal mid-point of the frontal area. Thus, a ball which impinges upon the lower half section will be deflected downwardly to simulate the hitting of a "grounder" by a batter whereas a ball which impinges upon the upper half section will be deflected upwardly to simulate the hitting of a "fly ball" by a batter. The intention is to thereby train the pitcher in the type of pitch to be delivered dependent upon the particular play-by-play situation which develops during a game.

The target is also constructed so as to provide for a limited vertical area along each of side walls 18, 20 which tapers outwardly and rearwardly as indicated by reference numerals 26, 28. The purpose of these areas is to impart to a ball which impinges upon such areas a rebounding direction which is outward of the longitudinal center line of the target. Such areas will thereby assist the pitcher in learning that when pitching to the inside of a right handed batter he can expect that the ball will be "pulled" along the foul line and that a ball pitched to the inside of a left handed batter will be "pulled" along the opposite foul line.

Figure 3:
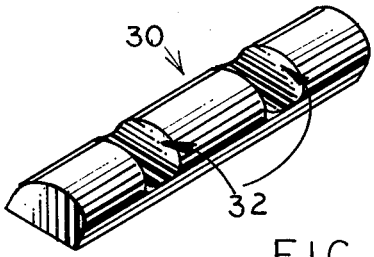
FIG. 3 is a perspective view of an elongate element used to impart a laterally directed force to a ball which impinges upon the element.
Figure 2:
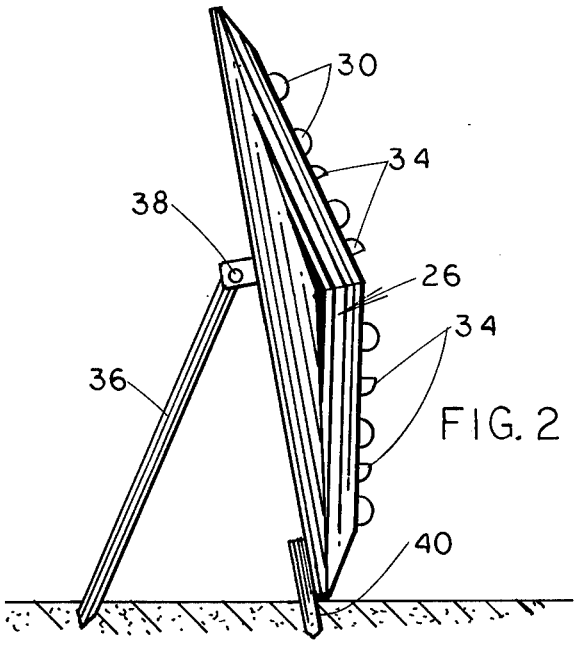
FIG. 2 is a side elevational view of the pitcher's target shown in FIG. 1.
Figure 4:
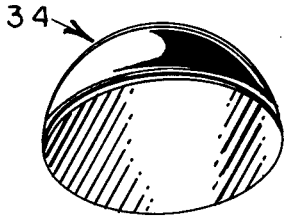
FIG. 4 is a perspective view of an arcuate element used to impart a vertically directed force to a ball which impinges upon the element.

A plurality of elongated elements 30 are secured to the upper and lower half sections of the frontal area as can be seen most clearly from FIG. 1. These elements are provided with notched areas configured to impart a substantially laterally directed force component to a ball which strikes such elements. As can be seen from FIG. 3 the elements 30 are each preferably formed with a plurality of notches 32 therein, the side of each notch being desirably angled with the same degree of slope albeit with reverse inclinations. It will be appreciated, however, that the elongated elements may be semi-cylindrical strips which provide the same rebounding characteristics. The elements 30 secured to the upper half section of the target, although imparting a laterally directed force component to the impinging ball, will nevertheless still deflect the ball upwardly due to the basic taper of the underlying wall surface. Similarly, elements 30 secured to the lower half section of the target's frontal area will impart laterally and downwardly directed force components to the impinging ball.

A plurality of arcuately contoured elements 34 are secured at spaced locations to both the upper and lower half sections and afford additional localized areas where force components are imparted to an impinging ball in specific directions. Thus, the arcuately contoured elements secured to the upper half section impart a generally upward vertical force component which is greater than that imparted by the adjacent wall surface whereas the elements 34 secured to the lower half section of the frontal area impart a sharper downwardly directed vertical force component than that of the adjacent wall surface. The arcuately contoured elements may desirably be formed as convex shaped semi-spherical pieces.

The provision of the elongated elements 30 and the arcuately contoured elements 34 thus introduces an element of uncertainty into the expected rebound trajectory of the ball as is realistically to be anticipated during the actual playing of a baseball game. However, balls pitched against the lower half section of the target will still return a "grounder" although of varying angles and velocities whereas balls pitched against the upper half section of the target will result in simulated "fly balls" although differing in direction and in arc.

To facilitate positioning of the target firmly in the ground a support member 36 may be connected to the back of the target and may be made pivotable as by means of a pivot pin 38. The lower extremity of the support member is desirably pointed to simplify insertion into the ground. A stake element 40 may be secured to the lower end of the target to afford greater positional stability.

It will be understood that the width of the target should approximate the width of a home plate on a baseball field, and a width of approximately 12 to 18 inches has been found to be quite suitable. The height of the frontal area should approximate that of the "strike zone" and may be within the range of from 3 to 4 feet.

It will also be understood that a few random-placed elements 34 imparting a downwardly-directed force component may be secured to the upper half section of the frontal area whereas a few random-placed elements 34 imparting an upwardly-directed force component may be secured to the lower half section without detracting from the predetermined teaching scheme of the device and introducing additional realism to the design.

The spacing of the elements 30 and 34 should be sufficient to permit a ball having a size roughly equivalent to that of an official baseball to fit therebetween so as to squarely the flat wall surface to be deflected by such surface according to its taper.

From the foregoing it will be seen that a baseball pitcher's practice target has been provided which will reinforce the teaching of certain pitching fundamentals by affording a contoured wall surface and projecting elements which will impart force components to an impinging ball consistent with such pitching fundamentals.

I claim:

1. A baseball pitcher's target comprising:

a rebound wall surface defined by opposed side walls and opposed end walls, said wall surface including a frontal area divided into a downwardly and rearwardly tapered lower half section and an upwardly and rearwardly tapered upper half section, said upper and lower half sections being provided adjacent each of said side walls with vertically-extending rearwardly and outwardly tapered portions;

a plurality of elongated notched elements secured to said frontal area adapted when struck by a ball to impart to the ball a laterally directed force component;

and a plurality of arcuately contoured elements secured to said frontal area adapted when struck by a ball to impart to the ball a vertically directed force component.

2. A baseball pitcher's target according to claim 1, wherein substantially all of the arcuately contoured elements secured to the lower half section of said frontal area are contoured to impart a downwardly directed vertical force component and substantially all of the arcuately contoured elements secured to the upper half section of said frontal area are contoured to impart an upwardly directed vertical force component.

3. A baseball pitcher's target according to claim 1, wherein said arcuately contoured elements are convex shaped.

4. A baseball pitcher's target according to claim 1, including a pivotable support member secured to the back of said wall surface and at least one stake element secured to the lower portion of said wall surface, whereby said wall surface may be implanted in the ground.

5. A baseball pitcher's target according to claim 1, wherein said wall surface is dimensioned to approximate the width of a home plate and a height of from 3 to 4 feet.

* * * * *